US007051692B1

(12) United States Patent
Powers

(10) Patent No.: US 7,051,692 B1
(45) Date of Patent: May 30, 2006

(54) STARTING SYSTEM FOR A MARINE ENGINE

(75) Inventor: Loren T. Powers, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/000,713

(22) Filed: Dec. 1, 2004

(51) Int. Cl.
*F02M 1/12* (2006.01)

(52) U.S. Cl. ..... 123/179.15

(58) Field of Classification Search ..... None
See application file for complete search history.

(56) References Cited

U.S. PATENT DOCUMENTS

| | | | | |
|---|---|---|---|---|
| 3,872,851 | A * | 3/1975 | Matsumoto et al. | 123/179.15 |
| 3,888,223 | A | 6/1975 | Mondt | 123/136 |
| 3,924,591 | A | 12/1975 | Bond et al. | 123/122 H |
| 3,977,380 | A | 8/1976 | Atsumi et al. | 123/179 G |
| 4,461,249 | A | 7/1984 | Majkrzak | 123/142.5 E |
| 4,481,914 | A | 11/1984 | Ishida | 123/179 G |
| 4,494,498 | A * | 1/1985 | Ito et al. | 123/179.16 |
| 4,495,904 | A | 1/1985 | Sakaino et al. | 123/179 G |
| 4,509,472 | A | 4/1985 | Slattery | 123/179 G |
| 4,763,625 | A | 8/1988 | Staerzl et al. | 123/435 |
| 4,815,427 | A * | 3/1989 | Radtke | 123/179.14 |
| 4,836,157 | A | 6/1989 | Miller | 123/187.5 R |
| 4,905,641 | A | 3/1990 | Miller | 123/187.5 R |
| 5,462,024 | A * | 10/1995 | Nuti | 123/179.14 |
| 5,554,322 | A | 9/1996 | Kobayashi | 261/35 |
| 5,934,260 | A | 8/1999 | Gadkaree et al. | 123/520 |
| 6,375,526 | B1 | 4/2002 | Ikuma et al. | 440/88 |
| 6,779,503 | B1 | 8/2004 | Rado | 123/179.11 |
| 6,799,545 | B1 | 10/2004 | Shaw | 123/179.11 |

* cited by examiner

*Primary Examiner*—Andrew M. Dolinar
(74) *Attorney, Agent, or Firm*—William D. Lanyi

(57) ABSTRACT

An engine starting fuel enriching system provides a valve that is located downstream of an air feed conduit that is connected in fluid communication with a first fuel conduit. The fuel conduit is connected between a fuel reservoir and the valve. When the valve is in a closed position, both fuel and air are inhibited from flowing in a direction from the fuel reservoir and the air feed conduit toward the air intake manifold of the engine. A heater circuit is used to activate a valve actuator as a function of the temperature of the engine.

20 Claims, 6 Drawing Sheets

STARTING SYSTEM FOR A MARINE ENGINE

BACKGROUND OF THE INVENTION

1. Field of the Invention

The present invention is generally related to a starting system for a marine engine and, more particularly, to a starting system that provides a fast and reliable initiation of the engine operation without requiring the operator of a marine vessel to manipulate a throttle handle prior to activating the ignition system.

2. Description of the Prior Art

Many different types of systems have been developed to assist in starting an internal combustion engine, particularly when the engine is cold.

U.S. Pat. No. 3,888,223, which issued to Mondt on Jun. 10, 1975, describes a carburetor enrichment system. An air fuel supply system for an internal combustion engine has a carburetor connected to the intake manifold of the engine with a plurality of large diameter vapor ports formed below the carburetor throttle. A vapor pump draws hydrocarbon vapors and air from the gas tank and from a fuel vapor evaporative control canister having a vent opening thereto and an inlet connected to a vent conduit from the top of the gas tank.

U.S. Pat. No. 3,924,591, which issued to Bond et al. on Dec. 9, 1975, describes a quick warm-up intake manifold. The temperature control system for an intake manifold stove to vaporize fuel droplets during a cold enrichment mode of carburetor operation is disclosed. The system includes a heat riser valve operated in accordance with engine coolant temperature by means of a thermal vacuum valve operatively connected to a vacuum operator coupled to the heat riser valve.

U.S. Pat. No. 3,977,380, which issued to Atsumi et al. on Aug. 31, 1976, describes a starter assist device for an internal combustion engine. A starter assist device includes a supplemental air supply passage for the intake manifold arranged to bypass the carburetor, and a thermo-sensitive switch incorporated in the starter circuit and arranged to cause introduction of supplemental air into the intake manifold when the engine is started under conditions in which the engine is warm so that an oversupply of fuel is avoided, and to close off the supplemental air when the engine is started when cold to provide an adequate amount of fuel.

U.S. Pat. No. 4,461,249, which issued to Majkrzak on Jul. 24, 1984, describes a method and apparatus of starting a cold engine. The method includes heating intake air and a carburetor of a dead, cold internal combustion engine of a first vehicle which uses an apparatus that heats the cold engine with energy supplied by a second vehicle having a running internal combustion engine.

U.S. Pat. No. 4,481,914, which issued to Ishida on Nov. 13, 1984, describes an accelerator-pump system for carburetors. The pump supplies additional fuel into a primary intake passage when a primary throttle valve is opened. A vacuum-operated actuator is responsive to a vacuum developed in a manifold passage upon cranking for actuating an accelerator pump plunger to discharge extra fuel into the primary intake passage.

U.S. Pat. No. 4,495,904, which issued to Sakaino et al. on Jan. 29, 1985, describes an apparatus for facilitating engine starting. A solenoid operated cut valve controls flow through a vent passage leading from a float chamber for a carburetor for an internal combustion engine. A normally closed switch opens in response to high temperature of the engine, and a normally closed timer switch opens at the start of cranking and closes again after a predetermined time of cranking.

U.S. Pat. No. 4,509,472, which issued to Slattery on Apr. 9, 1985, discloses a starting enrichment of alternate firing two cycle internal combustion engine. A two cycle internal combustion engine has at least two cylinders which fire alternately with pressure in one crankcase at the time when a vacuum is in the other. Supplemental fuel flow passages extend from each crankcase and are joined at a common passage connected to the float bowl of the carburetor.

U.S. Pat. No. 4,763,625, which issued to Staerzl et al. on Aug. 16, 1988, discloses a cold start fuel enrichment circuit. The circuit for an internal combustion engine includes a thermistor sensing engine temperature, a voltage source continually biasing the thermistor such that the voltage across the thermistor continually varies with engine temperature and provides an output fuel enrichment signal, and a circuit connecting the engine battery through the start switch to the thermistor to additionally bias the thermistor during cranking of the engine. A combination cold start and knock prevention fuel enrichment circuit is also provided.

U.S. Pat. No. 4,836,157, which issued to Miller on Jun. 6, 1989, describes a cold start engine priming and air purging system. A fuel delivery system for purging air from the reservoir of a diaphragm carburetor on an internal combustion engine and for supplying priming fuel to the carburetor air intake is described. A manual pump has an inlet coupled by a fuel line through the carburetor reservoir to a fuel supply, and an outlet connected by the fuel line to the constant flow rate nozzle orifice positioned at the carburetor air intake.

U.S. Pat. No. 4,905,641, which issued to Miller on Mar. 6, 1990, describes a cold start engine priming and air purging system. The system for purging air from the reservoir of a diaphragm carburetor on an internal combustion engine is described. It supplies priming fuel to the carburetor air intake. A pump is responsive to electrical signals from priming control circuitry to draw fuel through the carburetor reservoir and to provide fuel under pressure to a nozzle positioned at the carburetor air intake.

U.S. Pat. No. 5,554,322, which issued to Kobayashi on Sep. 10, 1996, describes an apparatus for supplying starting fuel for a carburetor. The carburetor has a main fuel jet and a throttle valve in a mixing passage and an apparatus for automatically supplying an enriched fuel and air mixture when an engine is cranked for starting and initial running of the engine upon starting.

U.S. Pat. No. 5,934,260, which issued to Gadkaree et al. on Aug. 10, 1999, describes a fuel vaporization system for starting an internal combustion engine. A cold start fuel vapor emission control system is disclosed which has an intake manifold and a fuel tank. These comprise a housing for containing a honeycomb absorber for absorbing fuel vapor, a vapor passage for fluidly connecting the housing and the fuel tank, a charging system for measuring the quantity of absorbed fuel vapor, and a purging passage connecting the housing to an intake manifold for introducing a mixture comprised of the fuel vapor and air to the intake manifold.

U.S. Pat. No. 6,375,526, which issued to Ikuma et al. on Apr. 23, 2002, describes an outboard engine system. The engine includes an engine block, a cylinder head coupled to the engine block and having an intake port in one side thereof, a carburetor including a carburetor body disposed on one side of the engine block adjacent the intake port and having an intake passageway, and a bypass-type starting device mounted to the carburetor body, and an intake pipe means which connects the intake passageway and the intake port to each other.

U.S. Pat. No. 6,779,503, which issued to Rado on Aug. 24, 2004, describes an automatic engine priming system for rotary mowers. The priming system for a carburetor for small internal combustion engines is described, wherein the priming system is remotely actuated and includes an automatic primer disabling feature operative when the engine is in a warm condition to prevent the supply of an overly rich fuel/air mixture to the engine intake system during warm restarts.

U.S. Pat. No. 6,799,545, which issued to Shaw on Oct. 5, 2004, describes a carburetor start pump circuit. The circuit is for starting an engine and has an auxiliary fuel pump mounted on a relatively standard carburetor body, a start pulse passage extending through the carburetor body to the auxiliary fuel pump, and a fuel circuit having an intake side which extends from a metering chamber of the carburetor body to the auxiliary fuel pump and a discharge side which is interconnected to the intake side and extends from the auxiliary fuel pump to a throttle bore in the air intake of the carburetor body.

The patents described above are hereby expressly incorporated by reference in the description of the present invention.

In marine propulsion systems known to those skilled in the art, it is typical that an initial engine starting procedure, when the engine is cold, begins with a manual movement of a throttle handle from a neutral position to a wide open throttle (WOT) position in order to activate the accelerator pump for the purpose of providing fuel to the carburetor. The control handle, or throttle handle, of the marine vessel, is then moved back to a quarter throttle position in order to leave the throttle plate open for the purpose of providing sufficient air flow during the starting process. This procedure is not always followed precisely and, as a result, the operator of the marine vessel sometimes experiences difficulty in starting the engine of the marine propulsion system.

It would be significantly beneficial if a fuel system could be provided in order to assure more reliable and faster starting of the engine without requiring the operator to first manipulate the throttle handle in the manner described above. This would permit the operator of the marine vessel to simply activate the ignition system to start the engine.

SUMMARY OF THE INVENTION

An apparatus for facilitating the starting of an internal combustion engine, made in accordance with a preferred embodiment of the present invention, comprises a fuel reservoir, a first conduit connected in fluid communication with the fuel reservoir, an air feed conduit connected in fluid communication with the first conduit, a second conduit connected in fluid communication with an air intake manifold of the internal combustion engine, and a valve connected in flow control relation between the first conduit and the second conduit. In a preferred embodiment of the present invention, the valve is movable between a first position and a second position. The first position permits fluid flow from the first conduit to the second conduit and the second position inhibits fluid flow from the first conduit to the second conduit. The air feed conduit is disposed in fluid communication between the fuel reservoir and the valve. The second conduit is disposed in fluid communication between the valve and the intake manifold.

A method for facilitating the starting of an internal combustion engine, in accordance with a preferred embodiment of the present invention, comprises the steps of providing a first fuel reservoir, conducting a flow of fuel through a first passage from the first fuel reservoir, conducting a flow of air into fluid communication with the first passage from the first fuel reservoir, conducting a flow of fuel through a second passage into the air intake manifold of the internal combustion engine, providing a valve between the first and second passages, and permitting the flow of fuel from the first to the second passages when a preselected temperature is below a first threshold magnitude and inhibiting the flow of fuel from the first to the second passages when the preselected temperature is above a second threshold magnitude.

In certain embodiments of the present invention, a valve actuator is connected in force transmitting relation with the valve and is configured to cause the valve to be in the first position when the internal combustion engine is below the first preselected temperature and to be in the second position when the internal combustion engine is below the second preselected temperature. The valve actuator can comprise a wax element.

In a particularly preferred embodiment of the present invention, a heater can be connected in thermal communication with the valve actuator in order to control the position of the valve as a function of the temperature of the engine itself rather than the specific temperature of the valve actuator. The heater allows a microprocessor to raise the temperature of the valve actuator, as a function of the engine temperature, to compensate for differences in temperature between the internal combustion engine and the valve actuator itself.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
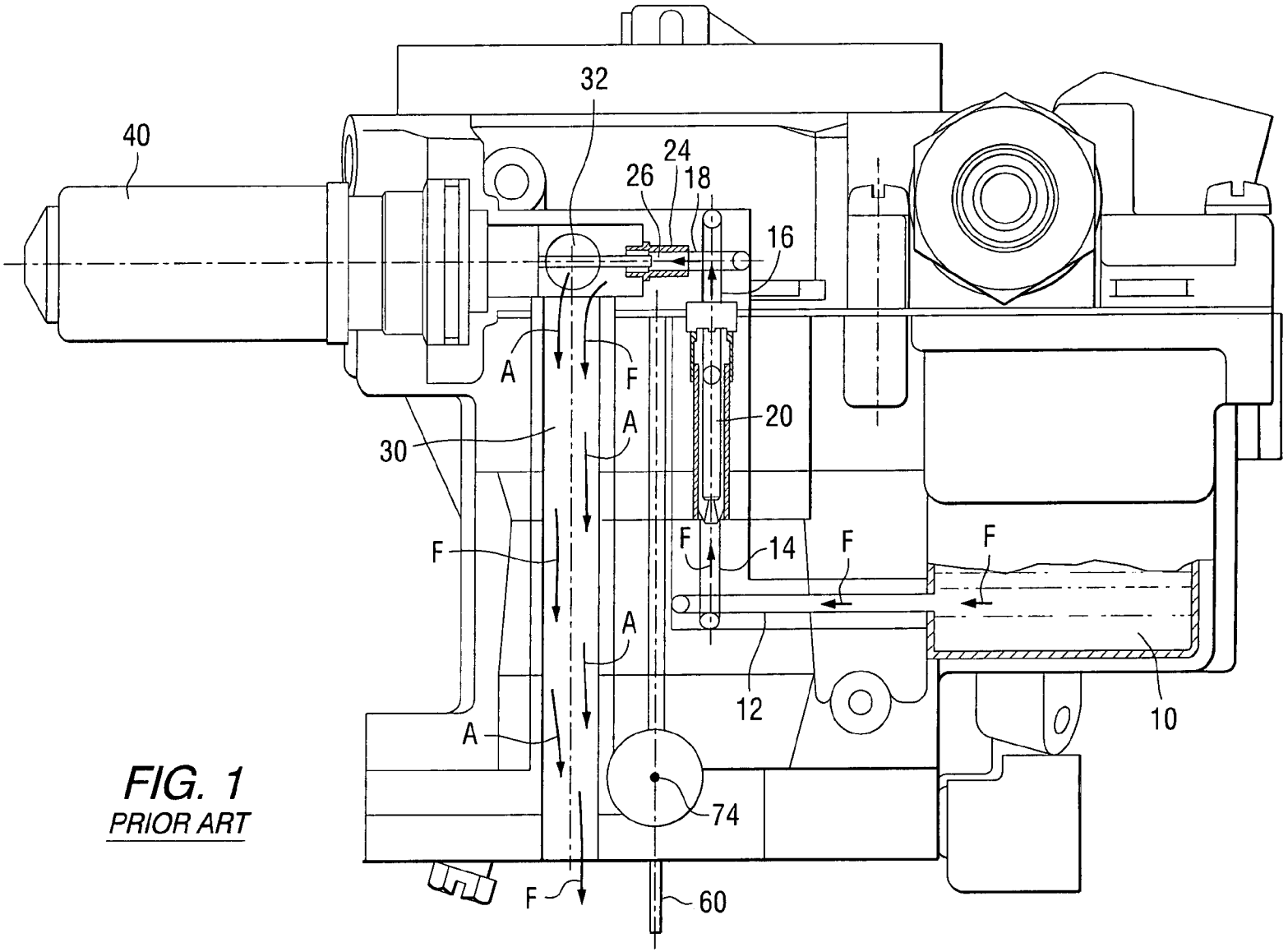
FIG. 1 PRIOR ART
FIG. 1 shows a fuel enriching circuit that is generally known to those skilled in the art.

Throughout the description of the preferred embodiment of the present invention, like components will be identified by like reference numerals.

FIG. 1 shows an apparatus that is generally known to those skilled in the art and is intended for use in starting an internal combustion engine, particularly when the engine is cold. The device shown in FIG. 1 is sometimes referred to by those skilled in the art as an "enriching system" or a "cold engine start fuel system." It contains a fuel reservoir 10 which is configured to provide fuel through a fuel passage that comprises conduits 12, 14, 16 and 18. An emulsion tube 20 is provided as a portion of the fuel passage comprising conduits 14 and 16. When operating to provide fuel during a starting procedure of an internal combustion engine, fuel flows from the reservoir 10 through the emulsion tube 20 and to a region, identified by reference numeral 24, where a valve 26 is movable between first and second positions. When in the first position, the valve 26 permits fluid to flow through conduit 18, through region 24, and into the passage identified by reference numeral 30. The fuel flow, when the valve 26 is in the first position, is identified by arrows F. This fuel flow continues through passage 30 and into the air intake manifold of an engine. The opening identified by reference numeral 32 is an air feed conduit and allows a flow of air to enter the stream of fuel F and flow through the passage 30 toward the air intake manifold. Arrows A represent the flow of air from the air feed conduit 32 into the passage 30.

With continued reference to FIG. 1, when the valve 26 is in the second position it blocks flow through the region identified by reference numeral 24. This inhibits the flow of fuel F from conduit 18 into passage 30. However, it is important to understand that in enriching systems known to those skilled in the art, as represented in FIG. 1, the movement of the valve 26 into its second, or blocking, position does not directly affect the flow of air A through the air feed conduit 32 into the passage 30 or into the air intake manifold.

With continued reference to FIG. 1, the emulsion tube 20 serves the purpose of allowing some air to mix with the fuel F as it passes upwardly through the emulsion tube 20. This results in the flow of a fuel mist upwardly through conduit 16 and, when valve 26 is in its first position, into passage 30 and toward the air intake manifold.

In FIG. 1, a housing 40 contains a valve actuator which moves the valve 26 along a horizontal path between its first and second positions. It is well known to those skilled in the art that a wax element can be used to move the valve 26 toward the right in FIG. 1 when the temperature of the wax element exceeds a predetermined magnitude. The internal operation of the valve actuator within the valve actuator 40 will be described in greater detail below.

As can be seen in FIG. 1, enriching systems known to those skilled in the art provide the air feed conduit 32 at a location downstream from the region 24 where the valve 26 is located. In other words, the air feed conduit 32 is located between the valve 26 and passage 30 which leads to the air intake manifold. As a result, the air feed conduit 32 remains connected in fluid communication with passage 30 and with the air intake manifold regardless of the position of the valve 26.

Figure 2:
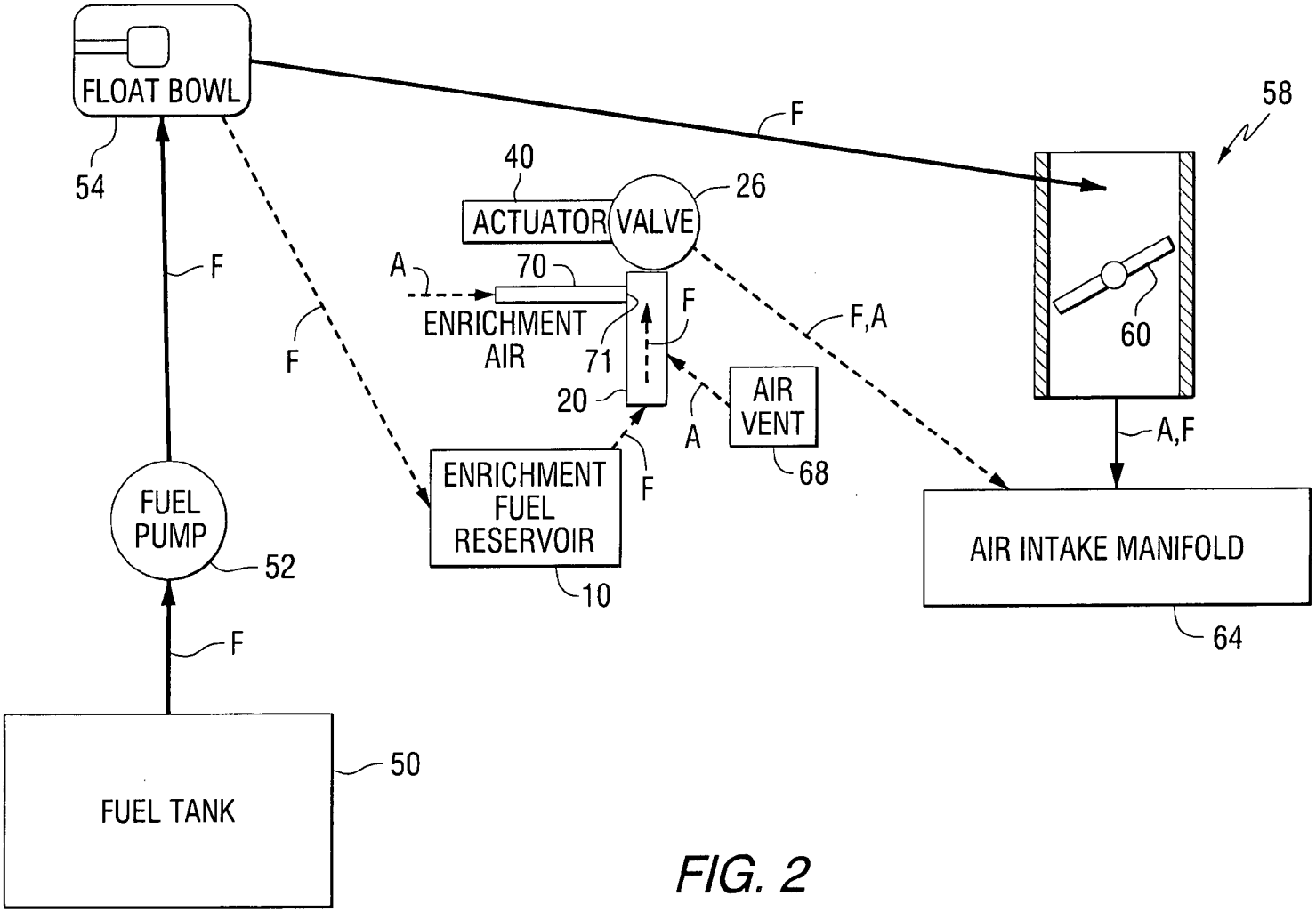
FIG. 2 is a simplified schematic representation of the primary fuel circuit and enrichment fuel circuit of an internal combustion engine.

FIG. 2 is a schematic representation which illustrates the primary fuel supply system of an internal combustion engine in conjunction with a preferred embodiment of the present invention. For purposes of reference, the primary fuel supply system is illustrated with solid line arrows while the enriching system is illustrated with dashed line arrows. The fuel flows F and air flows A are identified as such in FIG. 2.

The primary fuel tank of a marine vessel is identified by reference numeral 50. A fuel pump 52 draws fuel from the fuel tank and directs that fuel to a float bowl 54 or similar reservoir-like structure. From the float bowl 54, the fuel is directed to the carburetor 58. A butterfly valve 60 controls the amount of air and fuel flowing through the carburetor 58 toward the air intake manifold 64. The mixture of fuel and air is illustrated in FIG. 2 flowing from the carburetor 58 to the air intake manifold 64 of the engine.

With continued reference to FIG. 2, the fuel enriching system, or cold starting system, provides an enrichment fuel reservoir 10, which was described above in conjunction with FIG. 1, that receives fuel from the float bowl 54. It should be noted that a quantity of fuel typically remains within the enrichment fuel reservoir 10 when the engine is turned off. This provides a quantity of fuel that can later be used immediately upon the subsequent starting of the engine. The fuel contained in the enrichment fuel reservoir 10 is drawn toward the air intake manifold by the differential pressure created as a result of the reciprocal motion of the pistons of the engine in conjunction with the timely opening of the intake valves.

In FIG. 2, the fuel F is shown flowing from the enrichment fuel reservoir 10 into the bottom portion of the emulsion tube 20 where it mixes with air from the air vent 68. The valve 26 and its actuator 40 are shown downstream of the emulsion tube 20. The air feed conduit 70, which performs a similar function to the air feed conduit 32 described above, provides a flow of air through the air feed opening 71 which is located downstream of the emulsion tube 20. Although the air feed opening 71 is shown in FIG. 2 at the upper end of the emulsion tube 20, it should be understood that a physical embodiment of the present invention would most likely place this opening 71 at a location between the emulsion tube 20 and the valve seat of the valve 26. In FIG. 2, this relationship is schematically represented and does not represent an actual physical structure.

If the valve 26 is in its first position, fuel is allowed to flow to the air intake manifold 64 along with a mixture of air received from both the air feed conduit 70 and the air vent 68 of the emulsion tube 20. This flow of fuel and air from the valve 26 to the air intake manifold 64 bypasses the butterfly valve 60.

With continued reference to FIG. 2, it should be noted that closure of the valve 26, or placement of the valve 26 in its second position, blocks the flow of air A through the air feed conduit 70, the air vent 68, and the air connection opening 71 and thus does not permit this additional air to flow to the air intake manifold 64 when the valve 26 is in its second position. This blockage of air through the air feed conduit 70 can be important because it facilitates the calibration of the engine and allows greater accuracy. The additional flow of air through the air feed conduit 32 shown in FIG. 1 can be unpredictable and can provide a quantity of air to the air intake manifold, during normal operation of the engine, which adds to the quantity of air flowing through the throttle body mechanism of the carburetor 58. In a preferred embodiment of the present invention, the location of the air feed conduit 70 upstream from the valve 26 blocks that unpredictable flow of air to the air intake manifold 64 when the valve 26 is closed, or in its second position.

Figure 3:
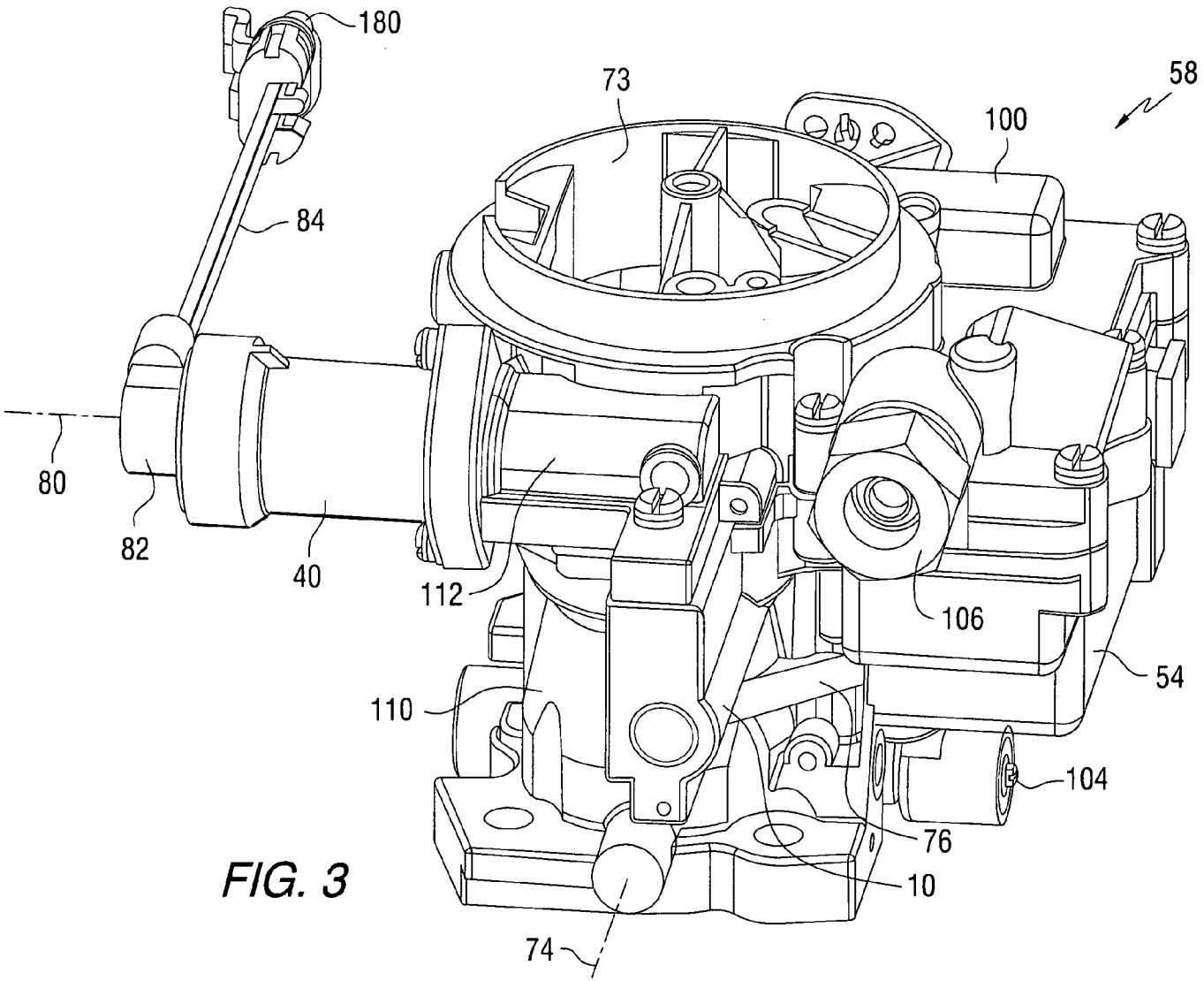
FIG. 3 is an isometric representation of a carburetor.

FIG. 3 is an isometric representation of a carburetor 58 made in accordance with a preferred embodiment of the present invention. The carburetor 58 comprises a primary air flow passage, or bore 73, through which air flows downwardly past a butterfly valve which is supported for rotation about axis 74. The butterfly valve 60, which is described above in conjunction with FIGS. 1 and 2, is not visible in FIG. 3. Fuel is conducted, through an enrichment fuel passage 76, from the float bowl 54 to the enrichment fuel reservoir 10. The actuator housing 40 contains the wax element described above, in conjunction with FIGS. 1 and 2, and a plunger mechanism that moves the valve 26 along the generally horizontal axis 80 between its first and second positions. An electric heater 82 is provided to change the temperature of the wax element within the valve actuator 40 in order to allow better control of the enriching system. The operation of the heater 82 will be described in greater detail below. The wires 84 provide electricity to operate the heater 82 under control of a temperature sensing switch, which can be connected in electrical communication to the heater by the connector 180 or, in certain embodiments, to a microprocessor such as an engine control module.

An accelerator pump 100, an idle mixture screw 104, and a fuel inlet fitting 106 can also be seen in FIG. 3. The venturi bore 110 is identified in FIG. 3. The valve 26, which is described above in conjunction with FIG. 2, is located within the structure identified by reference numeral 112.

Figure 4:
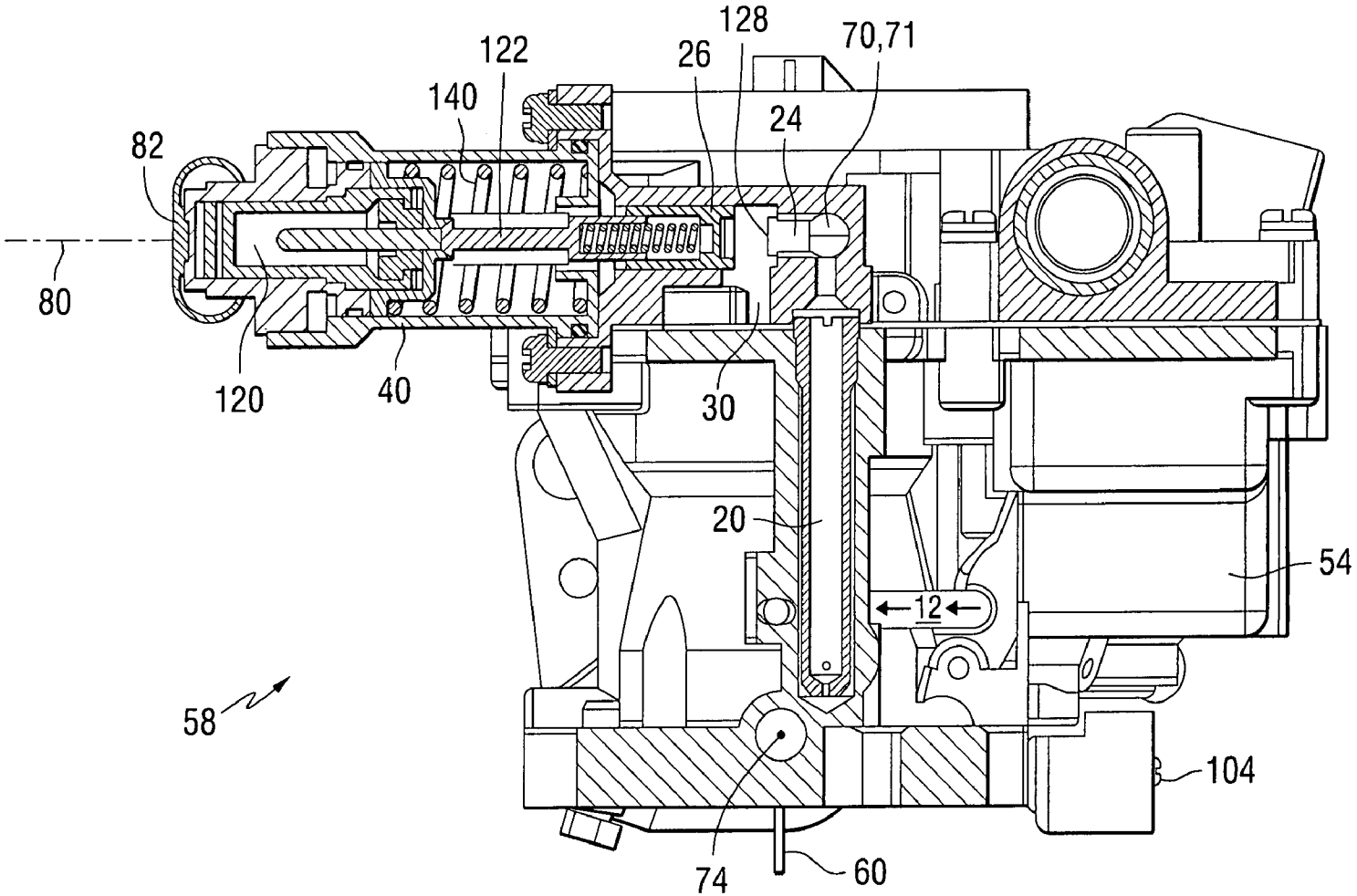
FIG. 4 is a section view of the carburetor shown in FIG. 3.

FIG. 4 is a section view of the carburetor 58. Within the valve actuator 40, the wax element 120 is configured to expand in response to increasing temperature. Expansion of the wax pellet 120 forces the plunger 122 of the valve actuator toward the right in FIG. 4. This moves the valve 26 from its first position, illustrated in FIG. 4, to a second position in which the valve moves into contact with a valve seat 128 to block flow through region 24. A spring 140 urges the plunger 122 of the actuator toward the left in FIG. 4 to maintain the valve 26 in its first, or opened position. Expansion of the wax element 120 overcomes this force of the spring 140 to move the valve 26 toward the right and toward its closed, or second position. Therefore, the temperature of the wax element 120 governs the position of the valve 26. As described above, when the valve 26 is in its first position, as illustrated in FIG. 4, fuel can flow through the enrichment fuel passage 12 and upwardly through the emulsion tube 20 and region 24. It then flows through the valve seat 128 and into the passage 30 that leads downwardly into the air intake manifold 64 as described above in conjunction with FIG. 2. Air is mixed with this fuel because of the air feed conduit 70 which directs a flow of air into fluid communication with the fuel flowing upwardly through the emulsion tube 20. This fuel/air mixture then flows through the opening of the valve seat 128 and downwardly through passage 30 toward the air intake manifold. When the valve 26 moves toward its second position, with the valve 26 in contact with the valve seat 128, fuel flow through the emulsion tube 20 and region 24 is blocked. Because of the location of the air feed conduit 70 in relation to the valve seat 128, air is also blocked from flowing through the air feed conduit 70. It can be seen, by comparing FIGS. 1 and 4, that the position of the air feed conduit 70 in a preferred embodiment of the present invention illustrated in FIG. 4 is upstream from the valve 26 and its valve seat 128. In other words, the air feed conduit 70 is between the valve 26 and the enrichment fuel reservoir 10 (not illustrated in FIG. 4). With reference to FIGS. 2, 3 and 4, it can be appreciated that the air feed conduit 70 is located between the valve 26 and the enrichment fuel reservoir 10, the enrichment fuel passage 12, and the emulsion tube 20. As a result, movement of the valve 26 into its second positions blocks the flow of fluid through the emulsion tube 20 and also through the air feed conduit 70. This prevents any flow to the air feed conduit 70 toward the air intake manifold when the valve 26 is closed, or in its second position.

The purpose of the wax element 120 is to use the valve 26 to activate or deactivate the enrichment circuit. When both the engine and the wax element 120 are cold, it is desirable to have the valve 26 in an open position to allow free flow of fuel and air from the enrichment fuel reservoir 10 and the emulsion tube 20 into the air intake manifold 64. When both the engine and the wax element 120 are at operating temperature, it is desirable to close the valve 26 and prevent flow of fuel through the enrichment system. Because of the location of the air feed conduit 70 of the present invention, this closure of the valve 26 when the engine is at operating temperature also prevents the flow of air through the air feed conduit 70 toward the air intake manifold 64. A certain condition can arise in which the temperature of the wax element 120 does not reliably conform to the temperature of the engine. For example, if the engine is operated for a short period of time which is sufficient to raise its temperature above a magnitude that could be considered a "cold start" temperature, it is not desirable to have the enrichment system operative. However, during that brief operation of the engine, which raised its temperature above this magnitude, followed by a brief period of inactivity, the wax element 120 may have sufficient opportunity and elapsed time to cool down to a temperature that allows the spring 140 to open the valve 26. This would place the valve 26 in its first position even though the engine itself is at a sufficiently high temperature to preclude the necessity of using the enrichment circuit. In other words, the physical location of the wax element 120 may allow it to cool down to a temperature which is less than the actual temperature of the engine. If the operator initiates an engine start procedure at this time, the wax element 120 would normally allow operation of the enrichment circuit because of the open position of the valve 26. The heater 82 allows this potentially disadvantageous circumstance to be avoided.

A temperature switch connector 180 (shown in FIG. 3) can be connected to a sensor which can be placed in thermal communication with the engine. If the temperature switch connector 180 comprises a normally open switch element, which closes when the engine temperature exceeds a preselected threshold, that temperature switch can provide electricity to the heater 82 which heats the wax element 120 whenever the engine is above that preselected temperature. In other words, the heater 82 causes the temperature experienced by the wax element 120 to simulate the actual temperature of the engine. When the engine is allowed to cool to a temperature below that which would require use of the enrichment circuit, the switch opens and allows the wax element 120 to cool and move the valve 26 toward its first position which is toward the left in FIG. 4. Upon the subsequent activation of the ignition system of the engine, the enrichment system is operative and will assist the activation of the engine with fuel passing through the emulsion tube 20.

Figure 5:
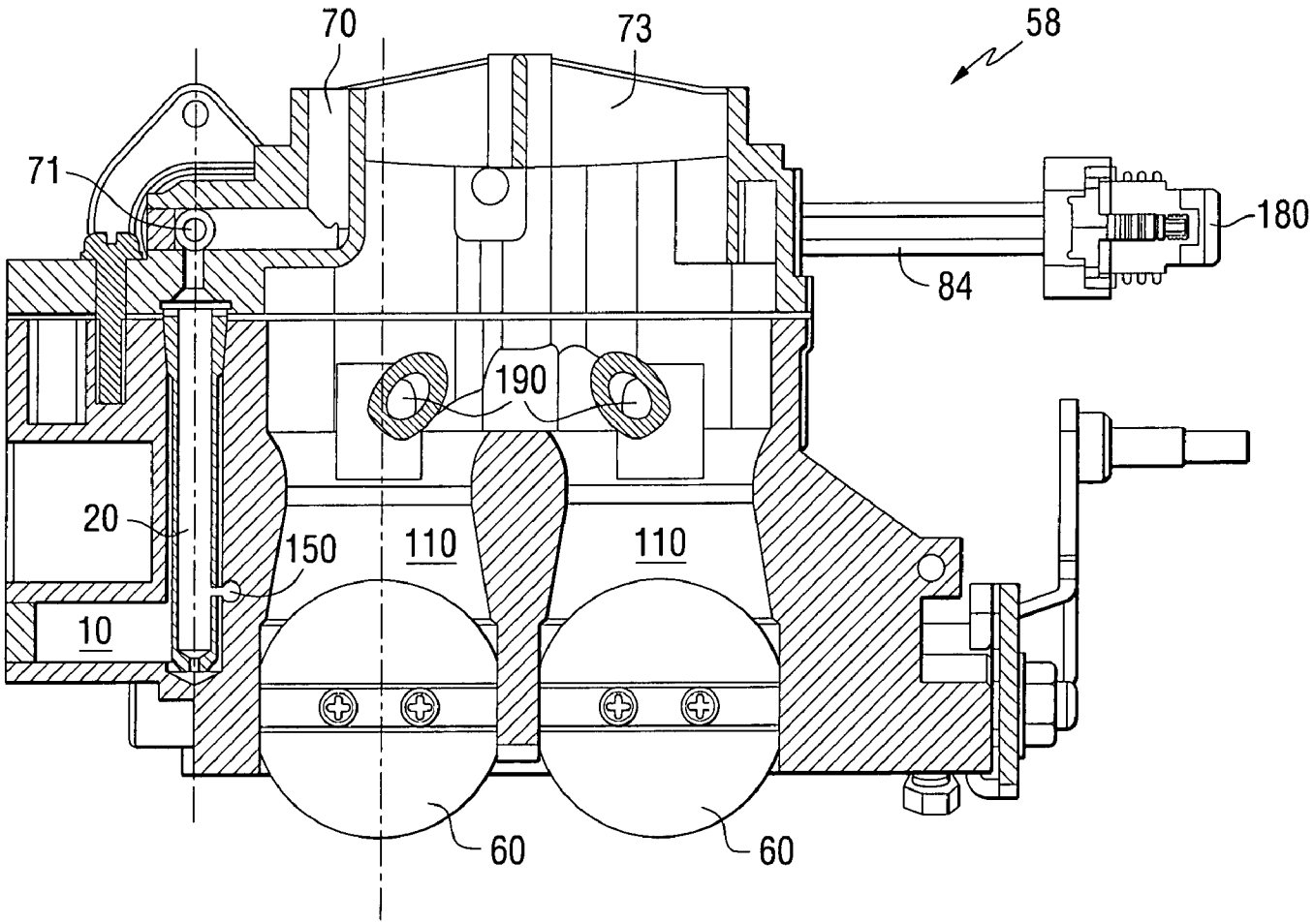
FIG. 5 is a section view of the carburetor shown in FIG. 3.

FIG. 5 is a section view of the carburetor 58 which is intended to show the relative locations of certain elements of the present invention. On the left side of FIG. 5, the enrichment fuel reservoir 10 is shown near the bottom portion of the emulsion tube 20. An opening 150 serves the purpose of the air vent 68 in FIG. 2 and is also illustrated proximate the bottom portion of the emulsion tube 20. The opening 150 allows a quantity of air to be mixed with fuel as it flows upwardly through the emulsion tube 20 before it reaches the air connection opening 71 downstream from the emulsion tube 20 and upstream from air feed conduit 70 which leads to the air intake manifold. Also shown in FIG. 5 are two butterfly valves 60 located below the venturi bores 110. The primary fuel system directs a fuel/air mixture through the openings identified by reference numeral 190.

Figure 6:
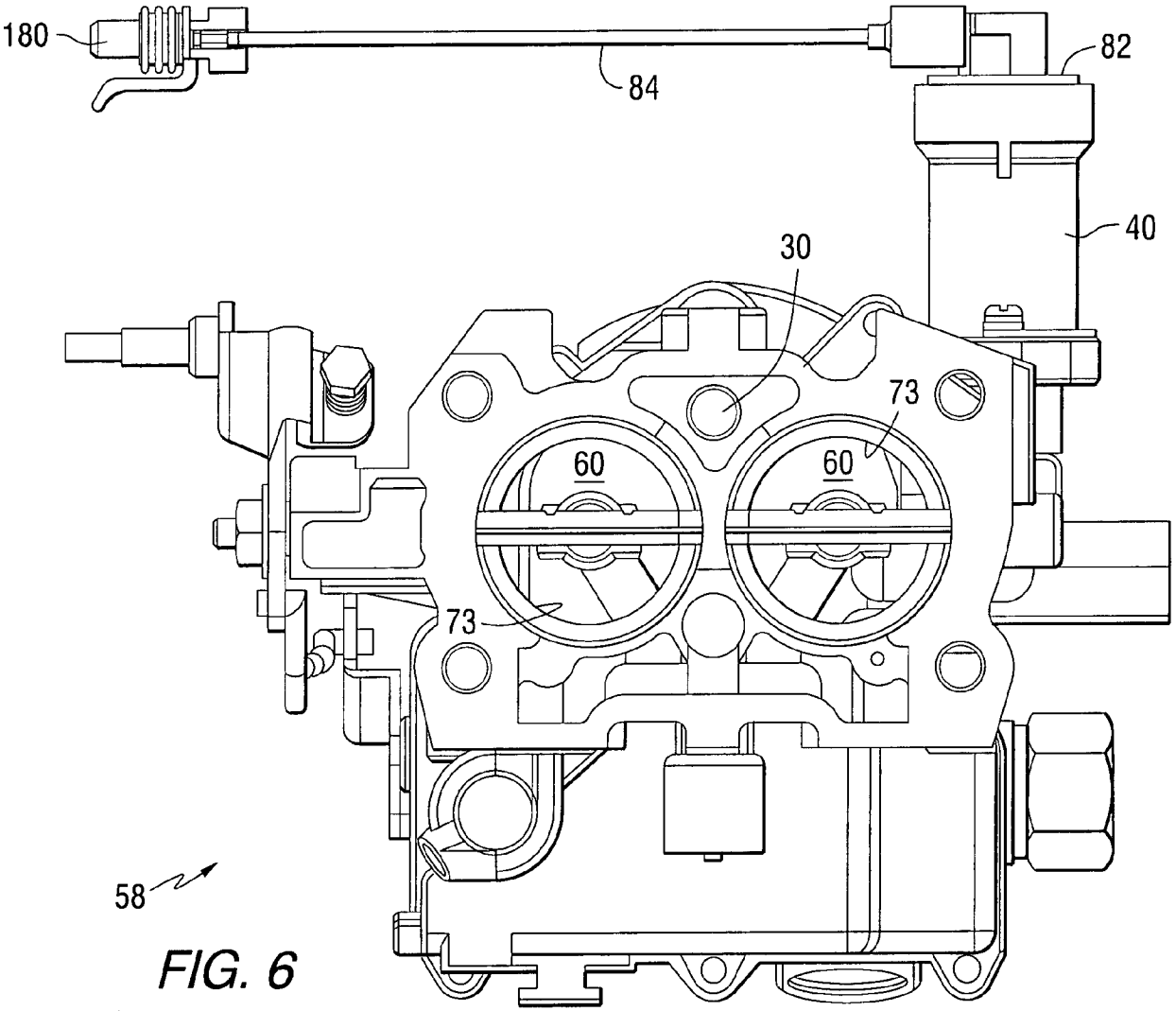
FIG. 6 is a bottom view of the carburetor shown in FIG. 3.

FIG. 6 is another view of the carburetor 58. The two butterfly valves 60 are shown. The passage 30 illustrates the position, relative to the two primary air passages 73 of the carburetor 58, where the enriching air fuel mixture passes through the body of the carburetor toward the air intake manifold. This opening is identified by reference numeral 30 and is described in conjunction with FIG. 1 (with reference to the prior art) and 4. FIG. 6 is a bottom view of the carburetor 58.

As described above, an apparatus for facilitating the starting of an internal combustion engine, made in accordance with a preferred embodiment of the present invention, comprises a first fuel reservoir 10 and a first conduit connected in fluid communication with the first fuel reservoir 10. The first fuel conduit comprises the passages between the first fuel reservoir 10 and a valve 26. An air feed conduit 70 is connected in fluid communication with the first conduit. A second conduit, such as the passage identified by reference numeral 30, is connected in fluid communication with an air intake manifold 64 of the internal combustion engine. The valve 26 is connected in flow control relation between the first conduit and the second conduit 30. The valve 26 is movable between a first position and a second position. The first position permits fluid flow from the first conduit to the second conduit 30. The second position inhibits fluid flow from the first conduit to the second conduit 30. The air feed conduit 70 is disposed in fluid communication between the fuel reservoir 10 and the valve 26. The second conduit 30 is disposed in fluid communication between the valve 26 and the intake manifold 64 of the internal combustion engine. A second fuel reservoir 54, or float bowl reservoir, can be connected in fluid communication with the first conduit. The second fuel reservoir can be a float controlled fuel bowl of the internal combustion engine. An air bleed conduit 150 can be connected in fluid communication with the first conduit and, more particularly, with the emulsion tube 20. The first conduit comprises the emulsion tube portion 20 within which liquid fuel-F from the first fuel reservoir 10 is mixed with air from the air bleed conduit 150. A valve actuator is configured to move the valve 26 in response to the temperature of the valve actuator. The valve actuator moves the valve 26 into the second position when the temperature of the valve actuator, or wax element 120, is greater than a first preselected magnitude. The valve actuator moves the valve into the first position, under the influence of spring 140, when the temperature of the valve actuator is less than a second preselected magnitude. The valve actuator contains the thermally sensitive wax element 120.

In a preferred embodiment of the present invention, it further comprises a valve actuator heater 82. A thermally responsive switch is provided for causing the valve actuator heater 82 to be energized in response to the internal combustion engine being at a temperature which is higher than a first preselected temperature threshold. The thermally responsive switch is configured to cause the valve actuator heater 82 to be de-energized in response to the internal combustion engine being at a temperature which is lower than a second preselected temperature threshold.

With continued reference to FIGS. 2–6, it can be seen that the apparatus for facilitating the starting of an internal combustion engine made in accordance with a particularly preferred embodiment of the present invention, provides a fuel reservoir 10, an air intake manifold 64 of an internal combustion engine, and a fuel supply conduit which is connected in fluid communication between the fuel reservoir 10 and the air intake manifold 64. In this terminology, the fuel supply conduit comprises the passages identified by reference numerals 12, 14, 16, 18, 20, and 30 illustrated in FIG. 1. This fuel supply conduit is configured to conduct a stream of fuel from the fuel reservoir 10 to the air intake manifold 64. An air supply conduit 70 is connected to this fuel supply conduit. The air supply conduit 70 is configured to conduct a stream of air into fluid communication with the stream of fuel flowing from the fuel reservoir 10. A valve 26 is associated with the fuel supply conduit. The valve 26 is disposable in a first position and a second position. The first position permits fuel to flow through the fuel supply conduit from the fuel reservoir 10 to the air intake manifold 64. The second position of the valve 26 inhibits fuel from flowing through the fuel supply conduit from the fuel reservoir 10 to the air intake manifold 64. The air supply conduit 70 is connected in fluid communication with the fuel supply conduit at a point upstream of the valve 26 and between the valve 26 and the fuel reservoir 10.

A valve actuator 40 is connected in force transmitting relation with the valve 26. The valve actuator 40 is configured to cause the valve 26 to be in the first position when the internal combustion engine is below a first preselected temperature and to be in the second position when the internal combustion engine is above a second preselected temperature. The valve actuator 40 comprises a wax element 120 in a particularly preferred embodiment and a heater 82 is connected in thermal communication with the valve actuator 40 in a preferred embodiment of the present invention.

Although the present invention has been described in particular detail and illustrated to show a preferred embodiment, it should be understood that alternative embodiments are also within its scope.

I claim:

1. An apparatus for facilitating the starting of an internal combustion engine, comprising:

a first fuel reservoir;

a first conduit connected in fluid communication with said fuel reservoir;

an air feed conduit connected in fluid communication with said first conduit;

a second conduit connected in fluid communication with an intake manifold of said internal combustion engine;

a valve connected in flow control relation between said first conduit and said second conduit, said valve being movable between a first position and a second position, said first position permitting fluid flow from said first conduit to said second conduit, said second position inhibiting fluid flow from said first conduit to said second conduit, said air feed conduit being disposed in fluid communication between said fuel reservoir and said valve, said second conduit being disposed in fluid communication between said valve and said intake manifold;

a valve actuator configured to move said valve in response to the temperature of said valve actuator, said valve actuator moving said valve into said second position when said temperature of said valve actuator is greater than a first preselected magnitude, said valve actuator moving said valve into said first position when a temperature of said valve actuator is less than a second preselected magnitude;

a valve actuator heater; and a thermally responsive switch for causing said valve actuator heater to be energized in response to said internal combustion engine being at a temperature which is higher than a first preselected temperature threshold.

2. The apparatus of claim 1, further comprising:

a second fuel reservoir connected in fluid communication with said first conduit.

3. The apparatus of claim 2, wherein:

said second fuel reservoir is a float controlled fuel bowl of said internal combustion engine.

4. The apparatus of claim 1, further comprising:

an air bleed conduit connected in fluid communication with said first conduit.

5. The apparatus of claim 4, wherein:

said first conduit comprises an emulsion tube portion within which liquid fuel from said first fuel reservoir is mixed with air from said air bleed conduit.

6. The apparatus of claim 1, wherein:

said valve actuator contains a thermally sensitive wax component.

7. The apparatus of claim 1, wherein:

said thermally responsive switch is configured to cause said valve actuator heater to be de-energized in response to said internal combustion engine being at a temperature which is lower than a second preselected temperature threshold.

8. An apparatus for facilitating the starting of an internal combustion engine, comprising:

a first fuel reservoir;

a first conduit connected in fluid communication with said fuel reservoir;

an air feed conduit connected in fluid communication with said first conduit;

a second conduit connected in fluid communication with an intake manifold of said internal combustion engine;

a valve connected in flow control relation between said first conduit and said second conduit, said valve being movable between a first position and a second position, said first position permitting fluid flow from said first conduit to said second conduit, said second position inhibiting fluid flow from said first conduit to said second conduit, said air feed conduit being disposed in fluid communication between said fuel reservoir and said valve, said second conduit being disposed in fluid communication between said valve and said intake manifold;

a valve actuator configured to move said valve in response to the temperature of said valve actuator, said valve actuator being configured to move said valve into said second position when said temperature of said valve actuator is greater than a first preselected magnitude, said valve actuator being configured to move said valve into said first position when a temperature of said valve actuator is less than a second preselected magnitude;

a valve actuator heater; and a thermally responsive switch for causing said valve actuator heater to be energized in response to said internal combustion engine being at a temperature which is higher than a first preselected temperature threshold.

9. The apparatus of claim 8, further comprising:

a second fuel reservoir connected in fluid communication with said first conduit, said second fuel reservoir being a float controlled fuel bowl of said internal combustion engine.

10. The apparatus of claim 8, further comprising:

an air bleed conduit connected in fluid communication with said first conduit.

11. The apparatus of claim 10, wherein:

said first conduit comprises an emulsion tube portion within which liquid fuel from said first fuel reservoir is mixed with air from said air bleed conduit.

12. The apparatus of claim 8, wherein:

said valve actuator contains a thermally sensitive wax component.

13. The apparatus of claim 8, wherein:

said thermally responsive switch is configured to cause said valve actuator heater to be de-energized in response to said internal combustion engine being at a temperature which is lower than a second preselected temperature threshold.

14. An apparatus for facilitating the starting of an internal combustion engine, comprising:

a first fuel reservoir;

a first conduit connected in fluid communication with said fuel reservoir;

a second conduit connected in fluid communication with an intake manifold of said internal combustion engine;

a valve connected in flow control relation between said first conduit and said second conduit, said valve being movable between a first position and a second position, said first position permitting fluid flow from said first conduit to said second conduit, said second position inhibiting fluid flow from said first conduit to said second conduit, said second conduit being disposed in fluid communication between said valve and said intake manifold;

a valve actuator configured to move said valve in response to the temperature of said valve actuator, said valve actuator moving said valve into said second position when said temperature of said valve actuator is greater than a first preselected magnitude, said valve actuator moving said valve into said first position when a temperature of said valve actuator is less than a second preselected magnitude;

a valve actuator heater; and a thermally responsive switch for causing said valve actuator heater to be energized in response to said internal combustion engine being at a temperature which is higher than a first preselected temperature threshold, said thermally responsive switch being configured to cause said valve actuator heater to be de-energized in response to said internal combustion engine being at a temperature which is lower than a second preselected temperature threshold.

15. The apparatus of claim 14, further comprising:

an air feed conduit connected in fluid communication with said first conduit, said air feed conduit being disposed in fluid communication between said fuel reservoir and said valve.

16. The apparatus of claim 14, further comprising:

a second fuel reservoir connected in fluid communication with said first conduit.

17. The apparatus of claim 16, wherein:

said second fuel reservoir is a float controlled fuel bowl of said internal combustion engine.

18. The apparatus of claim 14, further comprising:

an air bleed conduit connected in fluid communication with said first conduit.

19. The apparatus of claim 18, wherein:

said first conduit comprises an emulsion tube portion within which liquid fuel from said first fuel reservoir is mixed with air from said air bleed conduit.

20. The apparatus of claim 14, wherein:

said valve actuator contains a thermally sensitive wax component.

* * * * *